US008006681B2

(12) United States Patent
Chen

(10) Patent No.: US 8,006,681 B2
(45) Date of Patent: Aug. 30, 2011

(54) FIRING STRUCTURE OF PAINTBALL MARKER

(75) Inventor: Yi-Tsong Chen, Tainan (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 10 days.

(21) Appl. No.: 12/623,576

(22) Filed: Nov. 23, 2009

(65) Prior Publication Data

US 2010/0313866 A1 Dec. 16, 2010

(30) Foreign Application Priority Data

Jun. 10, 2009 (TW) ..... 98210272 U

(51) Int. Cl.
*F41B 11/00* (2006.01)

(52) U.S. Cl. ..... 124/73
(58) Field of Classification Search ..... 124/71–77
See application file for complete search history.

(56) References Cited

U.S. PATENT DOCUMENTS

| | | | | |
|---|---|---|---|---|
| 2004/0255923 | A1* | 12/2004 | Carnall et al. | 124/73 |
| 2005/0115551 | A1* | 6/2005 | Carnall et al. | 124/71 |
| 2005/0115554 | A1* | 6/2005 | Jones | 124/74 |
| 2007/0267005 | A1* | 11/2007 | Yeh | 124/74 |
| 2008/0087265 | A1* | 4/2008 | Yeh | 124/71 |
| 2009/0064980 | A1* | 3/2009 | Yeh | 124/71 |
| 2010/0101550 | A1* | 4/2010 | Carnall | 124/76 |

* cited by examiner

*Primary Examiner* — Troy Chambers
(74) *Attorney, Agent, or Firm* — WPAT, PC; Justin King

(57) ABSTRACT

A firing structure of a paintball marker includes a marker body and a firing cylinder. The marker body includes a barrel with mutually communicating first and second gas chambers. A stop edge is formed in the barrel at a junction between the first and second gas chambers. An O-ring is embedded in an inner wall of the barrel at a position inside the second gas chamber. The firing cylinder and a rear guide rod are put sequentially into the gas chambers. The firing cylinder has an outer periphery formed with a stop portion in the first gas chamber. The stop portion has a front edge mounted with a buffer washer corresponding in position to the stop edge of the barrel and having a planar surface. Thus, the process yield of the marker body can be increased, and the firing cylinder remains stable in high-speed action regardless of its position.

2 Claims, 5 Drawing Sheets

FIRING STRUCTURE OF PAINTBALL MARKER

BACKGROUND OF THE INVENTION

1. Field of the Invention

The present invention relates to firing structures of paintball markers and, more particularly, to a firing structure of a paintball marker wherein the firing structure includes a marker body having a high process yield and a firing cylinder that remains stable in high-speed action regardless of its position.

2. Description of Related Art

Generally, a paintball marker has a firing cylinder which is propelled by pressurized gas into reciprocating motion so as to fire paintballs. To increase the fun of paintball games, it is desirable to shorten the firing interval, accelerate paintball motion, and reduce the friction on paintballs. Furthermore, the structure of paintball markers must be simple in order to lower associated costs. Therefore, it is an important issue for paintball marker designers to increase the speed of paintball motion and keep the costs of paintball markers competitive.

In light of the foregoing, the applicant of the present application proposed a firing structure of a paintball marker, as shown in FIG. 5, and was granted Taiwan Patent (Utility Model) No. M309665 for the same. As shown in FIG. 5, the firing structure includes a marker body A, a firing cylinder B, and a rear guide rod C. The marker body A has a gas chamber A1 provided with a first gas duct A2 and a second gas duct A3. The first gas duct A2 has a front end extended with a stop edge A21. The firing cylinder B and the rear guide rod C are placed sequentially into the gas chamber A1 of the marker body A. The firing cylinder B has an end defined as a gas inlet end B1 and an opposite end defined as a gas outlet end B2. The firing cylinder B further has an outer periphery formed with a stop portion B3. The stop portion B3 has a front edge mounted with a buffer ring B31 and a rear edge mounted with a gasket ring B32. The stop portion B3 of the firing cylinder B is movable between the first gas duct A2 and the second gas duct A3. The rear guide rod C includes a piston block Cl fitting closely with the gas inlet end B1 of the firing cylinder B. Gas is fed into and discharged from the gas chamber A1 through the first gas duct A2 and the second gas duct A3, respectively, thus pushing the stop portion B3 of the firing cylinder B back and forth and thereby firing a paintball D. The firing structure described above has the following advantages:

1. The rear section of the firing cylinder is separate from the rear guide rod, so the two parts do not interfere with each other during firing.

2. As the pushing of paintballs and the accumulation of gas take place simultaneously, the time required for replenishing pressurized gas is shortened. Thus, the firing interval is minimized to add more fun to paintball games.

3. With a reduced number of airtight rings on the moving parts and hence less friction, the moving parts can move fast.

4. The structure is simple, can be conveniently disassembled, and therefore is less likely to result in failure of operation.

5. As the structure is simple and can be easily processed and assembled, associated costs can be reduced.

However, the aforesaid firing structure has the following drawbacks in use:

1. Since it is difficult to measure the surface roughness of the two-piece firing cylinder, precise processing is required. Consequently, high costs and a low process yield ensue.

2. As the gasket ring B32 is movable with the two-piece firing cylinder, the distance between the movable gasket ring B32 and O-rings embedded in an inner wall of the marker body A forward of the gasket ring B32 (as shown in FIG. 5) is shortened when the firing cylinder advances. Hence, the firing cylinder tends to be unstable during action.

3. While the buffer ring B31 is buffering the impact of the two-piece firing cylinder, the firing cylinder is positioned only through linear contact, and therefore the positioning effect is poor.

BRIEF SUMMARY OF THE INVENTION

In view of the above, the present invention provides a firing structure of a paintball marker as a solution to the foregoing drawbacks of the prior art, namely a low process yield due to difficulty in measuring the surface roughness of the firing cylinder, the poor positioning effect, and instability of the firing cylinder during action.

According to the present invention, a firing structure of a paintball marker includes a marker body and a firing cylinder. The marker body is provided with a hollow barrel, and the barrel is internally formed with a first gas chamber and a second gas chamber which communicate with each other. The first gas chamber has a larger inner diameter than the second gas chamber. In addition, a stop edge is formed in the barrel at a junction between the first gas chamber and the second gas chamber. Besides, an airtight O-ring is embedded in an inner wall of the barrel at a position in the second gas chamber. The firing cylinder, which is coupled in the barrel, is a hollow cylinder having two opposite ends, wherein the end proximal to the stop edge is defined as a proximal end, which serves as a gas inlet end, and the end distal from the stop edge is defined as a distal end, which serves as a gas outlet end. Moreover, the firing cylinder fits closely with the O-ring embedded in the inner wall of the barrel of the marker body. The firing cylinder has an outer periphery circumferentially formed with a stop portion in the first gas chamber of the barrel. The stop portion has a front edge mounted with a buffer washer. The buffer washer corresponds in position to the stop edge of the barrel and has a planar surface corresponding to the stop edge of the barrel.

The firing structure further includes a rear guide rod fixed at a distal end (with respect to the stop edge) of the first gas chamber of the barrel. The rear guide rod has a proximal end which is proximal to the stop edge and provided with a piston block. The piston block is mounted with a gasket ring which fits closely with the gas inlet end of the firing cylinder.

The present invention provides the following advantages:

1. As the processed surface of the bore of the marker body does not require high precision, the processing costs can be reduced, and the process yield increased.

2. With the airtight O-ring inside the marker body being fixed in position, the firing cylinder can remain stable during action regardless of its position.

3. The buffer washer has a planar contact surface that provides an enhanced buffering and positioning effect.

BRIEF DESCRIPTION OF THE SEVERAL VIEWS OF THE DRAWINGS

The invention as well as a preferred mode of use, further objectives, and advantages thereof will be best understood by referring to the following detailed description of an illustrative embodiment in conjunction with the accompanying drawings, in which.

DETAILED DESCRIPTION OF THE INVENTION

Figure 1:
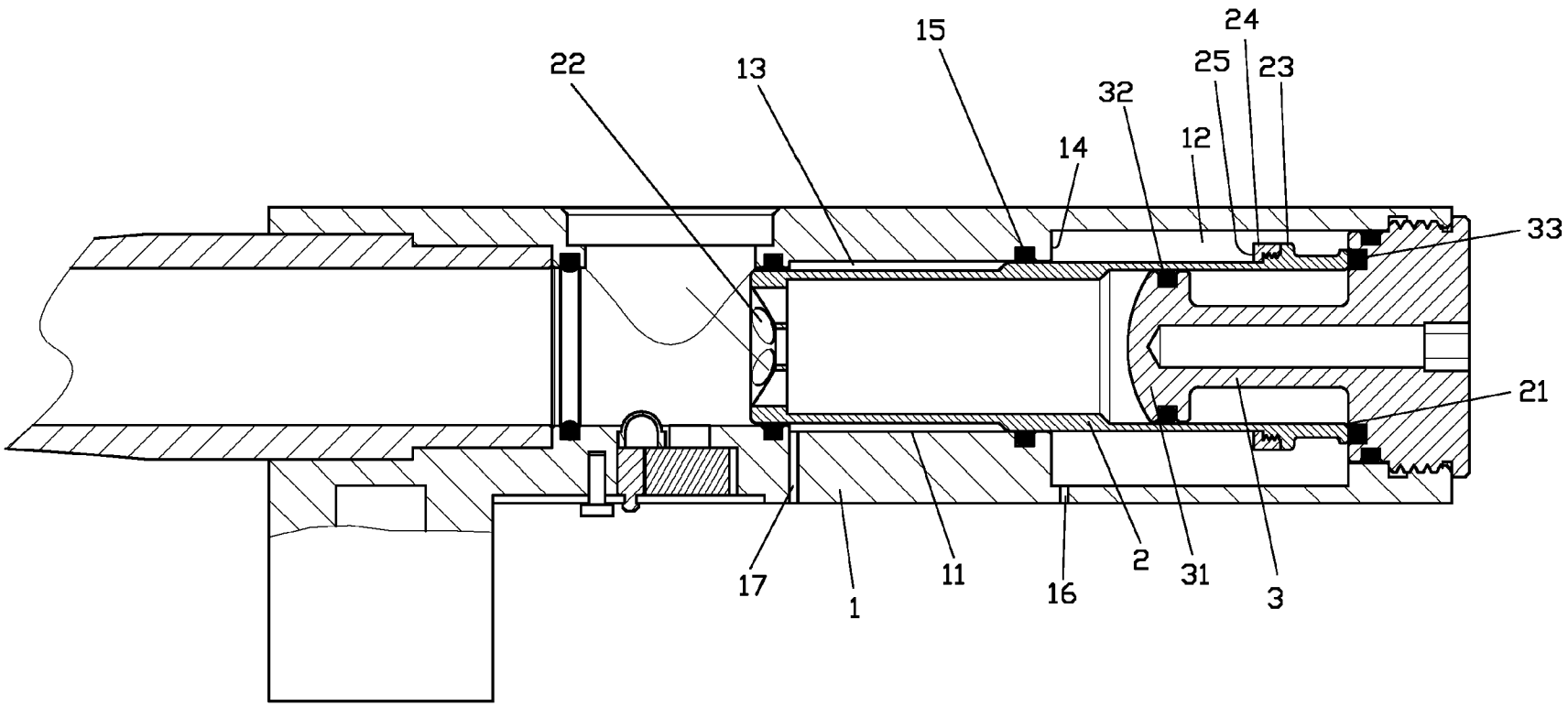
FIG. 1 is a sectional view of the present invention.

Referring to FIG. 1, according to the present invention, a firing structure of a paintball marker includes a marker body 1 and a firing cylinder 2.

The marker body 1 is provided with a hollow barrel 11. A first gas chamber 12 and a second gas chamber 13 are formed in the barrel 11 and communicate with each other, wherein the first gas chamber 12 has a larger inner diameter than the second gas chamber 13. In addition, a stop edge 14 is formed in the barrel 11 at a junction between the first gas chamber 12 and the second gas chamber 13. An airtight O-ring 15 is embedded in an inner wall of the barrel 11 at a position in the second gas chamber 13. The O-ring 15 is fixed in position and incapable of being moved. Besides, the first gas chamber 12 and the second gas chamber 13 are connected with a first gas duct 16 and a second gas duct 17, respectively.

The firing cylinder 2 is connected inside the barrel 11 and is formed as a hollow cylinder having two opposite ends, including a proximal end which is proximal to the stop edge 14 and serves as a gas inlet end 21, and a distal end which is distal from the stop edge 14 and serves as a gas outlet end 22. The firing cylinder 2 fits closely with the O-ring 15 embedded in the inner wall of the barrel 11 of the marker body 1. Furthermore, the firing cylinder 2 has an outer periphery circumferentially provided with a stop portion 23 in the first gas chamber 12 of the barrel 11. The stop portion 23 is mounted with a buffer washer 24, and the buffer washer 24 has a planar surface 25 corresponding to the stop edge 14 of the barrel 11. Thus, when the buffer washer 24 on the stop portion 23 of the firing cylinder 2 impacts the stop edge 14 of the barrel 11 during a high-speed reciprocating motion of the firing cylinder 2, an enhanced buffering and positioning effect is obtained.

The firing structure according to the present invention further includes a rear guide rod 3 which is fixed at a distal end (with respect to the stop edge 14) of the first gas chamber 12 of the barrel 11. The rear guide rod 3 has a proximal end which is proximal to the stop edge 14 and provided with a piston block 31. The piston block 31 is mounted with a gasket ring 32 fitting closely with the gas inlet end 21 of the firing cylinder 2. The rear guide rod 3 further has a rear end provided with a buffer ring 33 for buffering the impact of the firing cylinder 2 when the firing cylinder 2 recoils.

Figure 2:
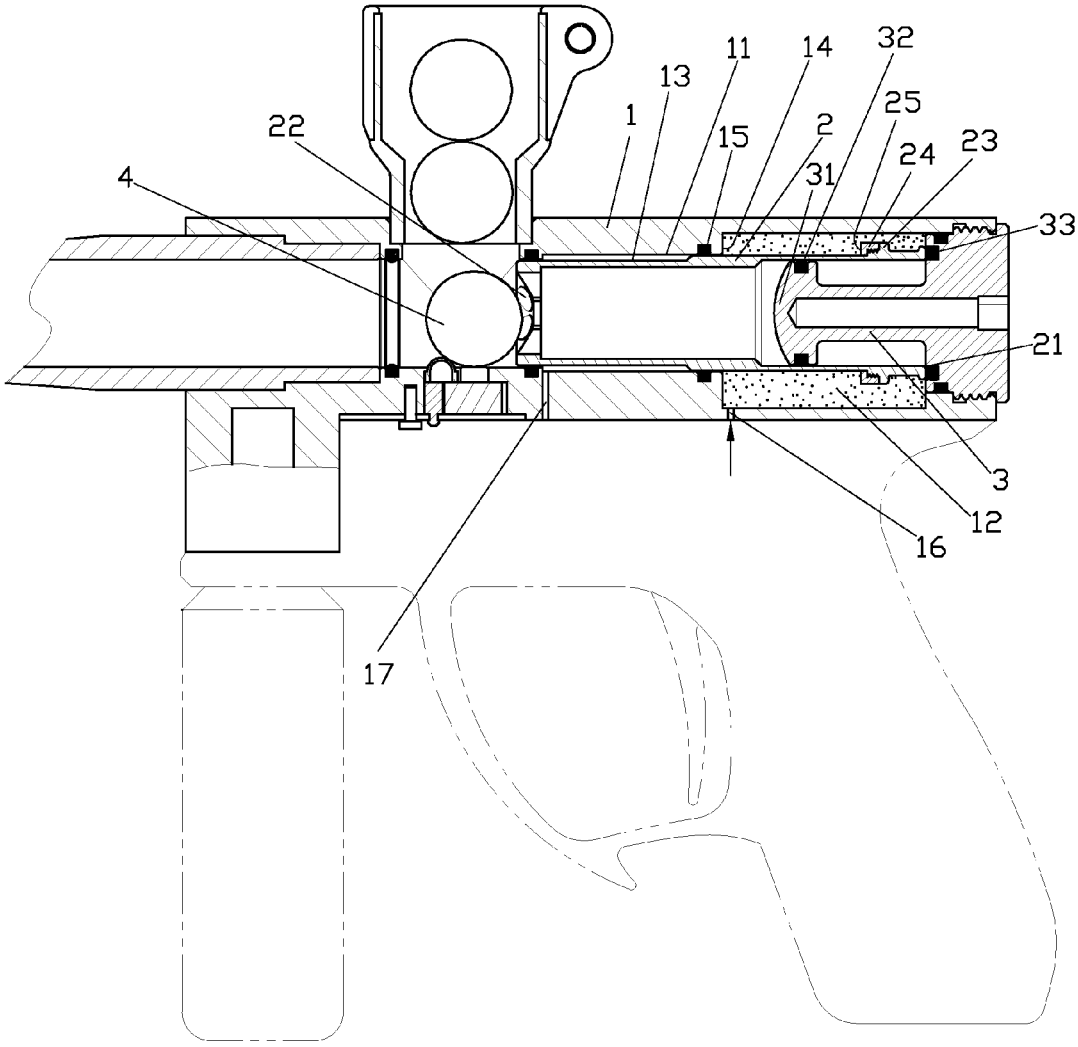
FIG. 2 is a sectional view of the present invention being applied to a paintball marker and in a gas intake stage so as to store pressurized gas.

In a gas intake stage as shown in FIG. 2, the first gas duct 16 and the second gas duct 17 of the marker body 1 are connected with pressurized gas, respectively. The pressurized gas is fed into the first gas chamber 12 of the marker body 1 through the first gas duct 16. During this stage, the O-ring 15 embedded in the inner wall of the barrel 11 and located in the second gas chamber 13 presses tightly against the outer periphery of the firing cylinder 2, and the gasket ring 32 of the rear guide rod 3 presses tightly against the gas inlet end 21 of the firing cylinder 2. Thus, an airtight closed space is formed for storing and accumulating the pressurized gas. As the pressurized gas continuously enters the first gas chamber 12 through the first gas duct 16, the pressure of the pressurized gas inside the first gas chamber 12 increases.

Figure 3:
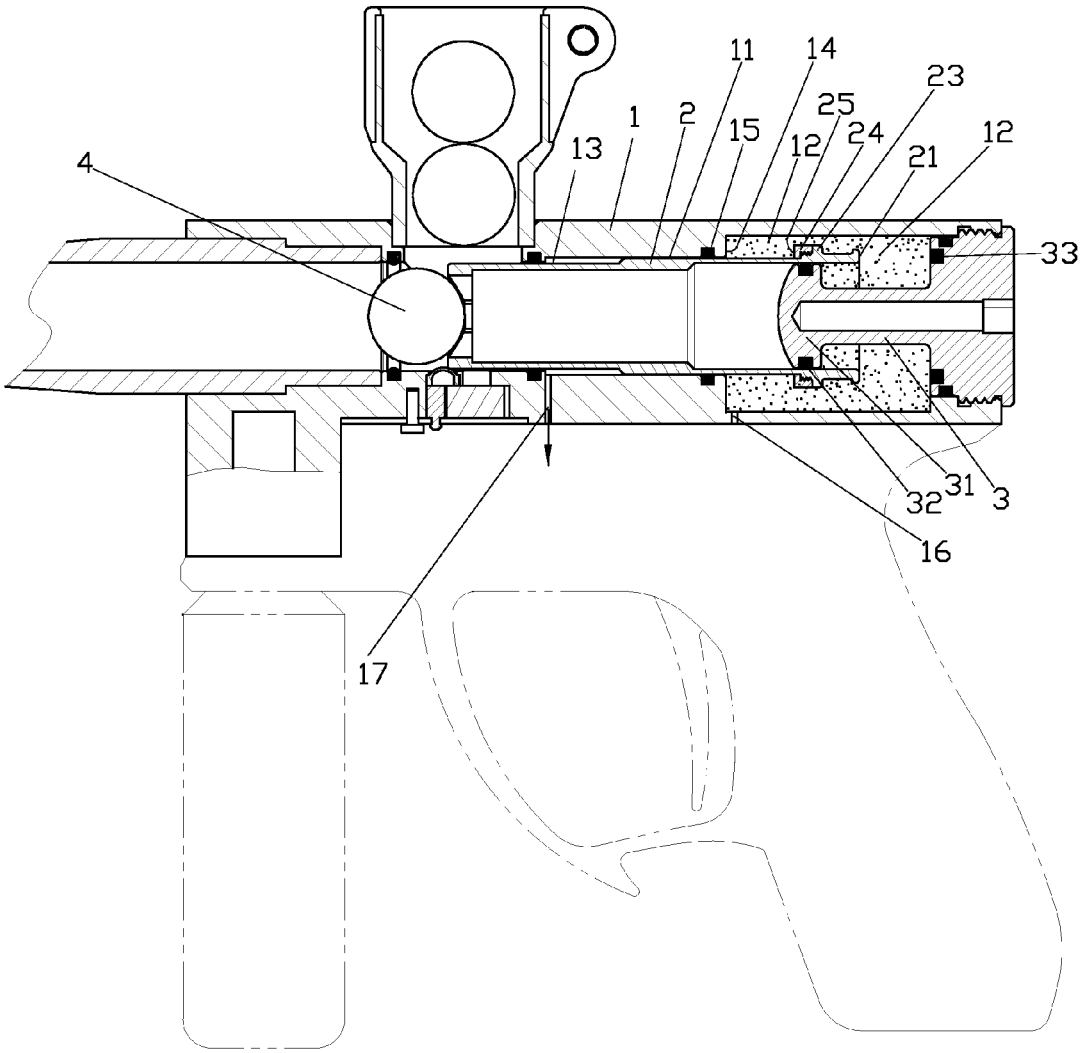
FIG. 3 is a sectional view showing a firing action of the present invention.

Then, during a firing action as shown in FIG. 3, the pressurized gas in the first gas chamber 12 pushes the gas inlet end 21 of the firing cylinder 2 while the second gas duct 17 begins to discharge. As a result, the stop portion 23 starts to slide in the first gas chamber 12. Since the airtight O-ring 15 in the barrel 11 is stationary and immovable, when the firing cylinder 2 moves, the outer periphery of the firing cylinder 2 remains in contact with the O-ring 15 embedded in the inner wall of the barrel 11, thus allowing the firing cylinder 2 to stay stable regardless of its position. Furthermore, as it is not necessary for the bore surface of the marker body 1 to be processed with high precision, the processing costs can be lowered, and the process yield increased. When the gas inlet end 21 of the firing cylinder 2 moves along with the stop portion 23 and slides out of engagement with the buffer ring 33 of the rear guide rod 3, a gap is formed between the gas inlet end 21 and the buffer ring 33. When the gas inlet end 21 of the firing cylinder 2 eventually disengages from the piston block 31 of the rear guide rod 3 such that the gasket ring 32 no longer presses tightly against the gas inlet end 21, the pressurized gas in the first gas chamber 12 is introduced into the gas inlet end 21 of the firing cylinder 2 and gushes through the gas outlet end 22, thereby firing a paintball 4.

Figure 4:
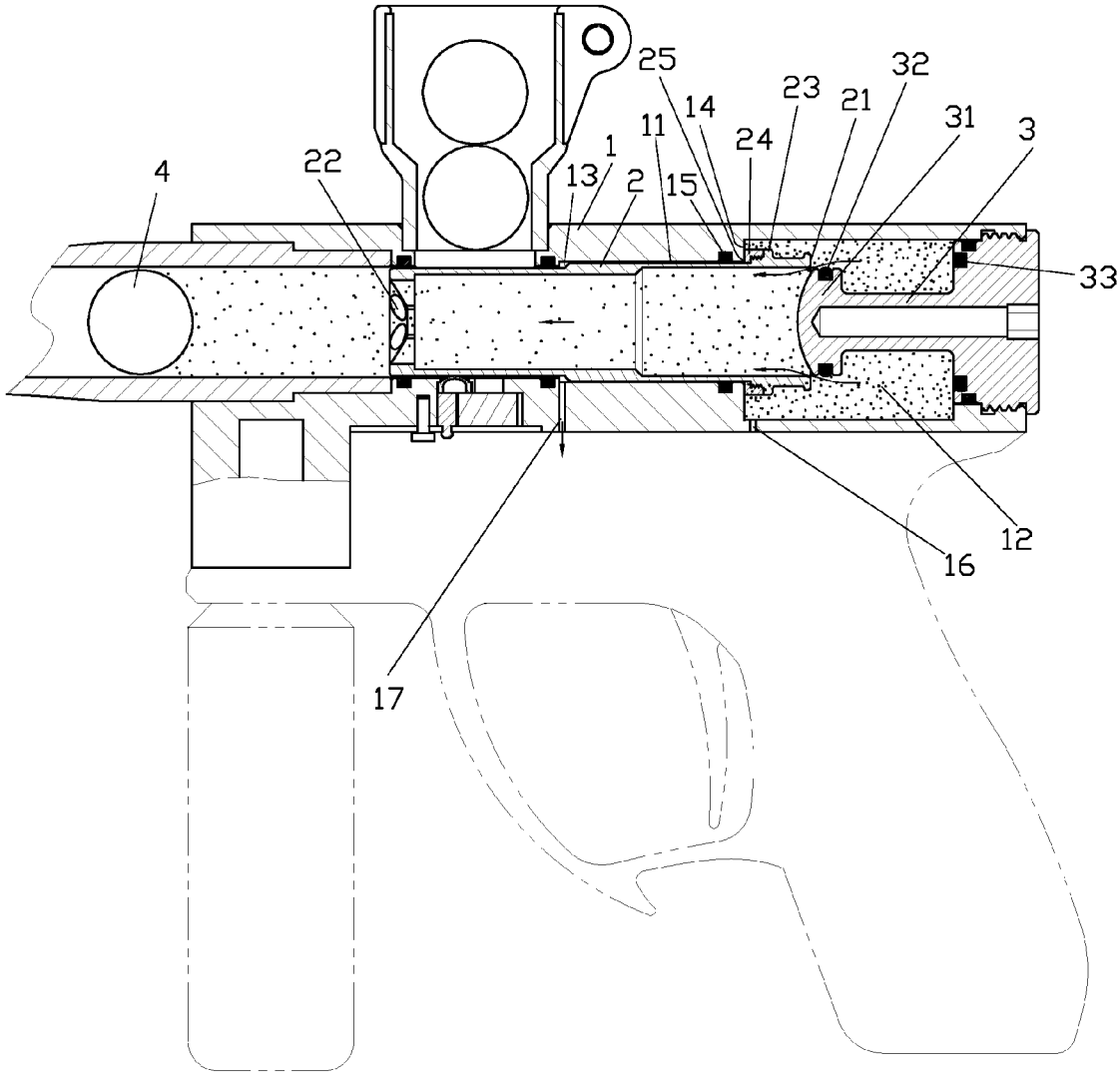
FIG. 4 is a sectional view showing the present invention after firing.
Figure 5:
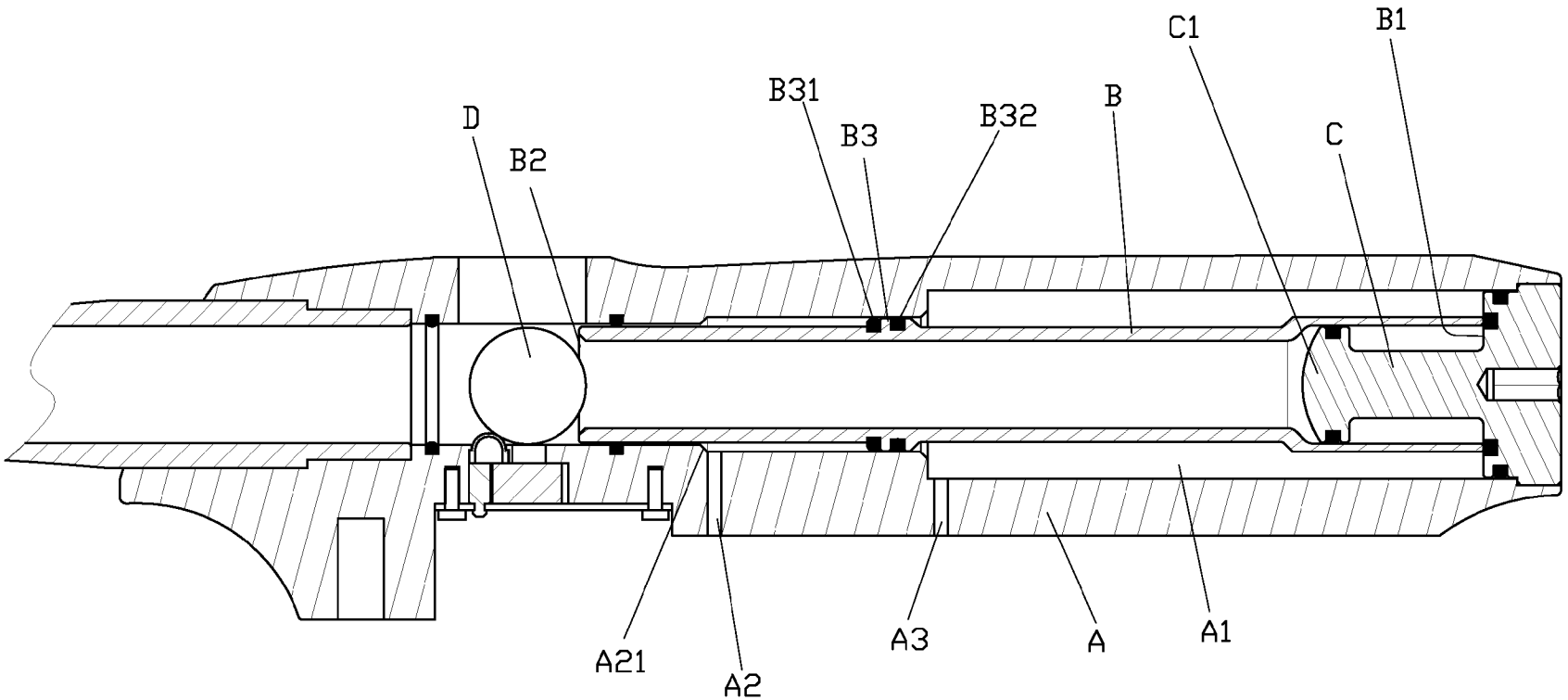
FIG. 5 Prior Art
FIG. 5 is a sectional view of a conventional firing structure of a paintball marker.

After the paintball 4 is fired, the buffer washer 24, which is mounted at a front edge of the stop portion 23 of the firing cylinder 2, impacts the stop edge 14 located in the marker body 1 at the junction between the first gas chamber 12 and the second gas chamber 13. The planar contact surface 25 of the buffer washer 24 provides an enhanced buffering and positioning effect while the firing cylinder 2 is moving at high speed, as shown in FIG. 4.

What is claimed is:

1. A firing structure of a paintball marker, comprising:

a marker body provided with a hollow barrel, the barrel being formed therein with a first gas chamber and a second gas chamber which communicate with each other, wherein the first gas chamber has a larger inner diameter than the second gas chamber, the barrel being formed therein with a stop edge at a junction between the first gas chamber and the second gas chamber, the barrel having an inner wall embedded with an airtight O-ring at a position inside the second gas chamber; and a firing cylinder connected in the barrel and formed as a hollow cylinder having two opposite ends, namely a proximal end which is proximal to the stop edge and serves as a gas inlet end and a distal end which is distal from the stop edge and serves as a gas outlet end, the firing cylinder fitting closely with the O-ring embedded in the inner wall of the barrel of the marker body, the firing cylinder having an outer periphery circumferentially provided with a stop portion in the first gas chamber of the barrel, the stop portion having a front edge mounted with a buffer washer corresponding in position to the stop edge of the barrel, the buffer washer having a planar surface corresponding to the stop edge of the barrel.

2. The firing structure of claim 1, further comprising a rear guide rod fixed at a distal end (with respect to the stop edge) of the first gas chamber of the barrel, the rear guide rod having a proximal end which is proximal to the stop edge and provided with a piston block, the piston block being provided with a gasket ring fitting closely with the gas inlet end of the firing cylinder.

* * * * *